US006101917A

United States Patent [19]

Klatte et al.

[11] Patent Number: 6,101,917

[45] Date of Patent: Aug. 15, 2000

[54] TURRET DRIVE MECHANISM

[75] Inventors: Kevin Mathew Klatte, Milford; Dennis Jerome Malone, Indian Springs, both of Ohio

[73] Assignee: O'Gara-Hess & Eisenhardt Armoring Co., Fairfield, Ohio

[21] Appl. No.: 09/085,078

[22] Filed: May 26, 1998

[51] Int. Cl.[7] ..... F41A 27/20; F41A 27/22

[52] U.S. Cl. ..... 89/41.01; 89/40.03

[58] Field of Search ..... 89/41.01, 41.22, 89/37.13, 37.11, 37.07, 40.03

[56] References Cited

U.S. PATENT DOCUMENTS

| | | | |
|---|---|---|---|
| 1,319,194 | 10/1919 | Walker . | |
| 2,395,310 | 2/1946 | Wilson . | |
| 3,429,222 | 2/1969 | Whiston et al. | 89/41.01 |
| 4,574,685 | 3/1986 | Sanborn et al. . | |
| 4,579,036 | 4/1986 | LeBlanc | 89/41.12 |
| 4,607,562 | 8/1986 | LeBlanc | 89/40.03 |
| 4,686,888 | 8/1987 | Sanborn et al. . | |
| 4,858,514 | 8/1989 | Argon | 89/41.01 |
| 4,867,037 | 9/1989 | Smith | 89/41.01 |

FOREIGN PATENT DOCUMENTS

| | | | |
|---|---|---|---|
| 3403927 | 5/1985 | Germany | 89/41.01 |
| 407231 | 9/1944 | Italy | 89/37.07 |

*Primary Examiner*—Stephen M. Johnson
*Attorney, Agent, or Firm*—Wood, Herron & Evans, L.L.P.

[57] ABSTRACT

A turret drive assembly fixedly secured to a turret causes rotation of the turret via rotation of an aiming wheel fixed to the turret drive assembly. The turret drive assembly comprises a drive mechanism which is operatively coupled to an aiming wheel and a first sprocket wheel so that rotation of the aiming wheel rotates the first sprocket wheel. Rotation of the first sprocket wheel rotates a second sprocket wheel which rotates a drive gear which is engaged with a fixed ring gear secured to a vehicle. Rotation of the drive gear, when engaged with the ring gear, rotates the turret. The drive gear and ring gear may be disengaged from one another and held in such a position.

17 Claims, 5 Drawing Sheets

TURRET DRIVE MECHANISM

FIELD OF THE INVENTION

This invention relates to the field of military vehicles and, in particular, to mechanisms for rotating a turret on top of a military vehicle.

DESCRIPTION OF THE PRIOR ART

Military vehicles are known to have a rotatable turret mounted to the top of the vehicle. A gun is usually mounted on the rotatable turret which an operator may fire from inside the vehicle. The turret is capable of rotating 360° in order to enable the operator to fire the gun in all directions from his or her position inside the vehicle.

With a relatively light weight gun and relatively light weight armor comprising the turret, the operator was able to rotate the turret manually by simply using his or her feet. A seat or sling was affixed to the inside of the turret so that the operator could sit in the seat or sling and by pushing laterally with his or her feet, manually rotate the turret.

However, as the weight of the armor of the turret itself and the weight of the gun increased, it became more and more difficult for an operator to exert enough force with his or her feet to sufficiently rotate the turret. Therefore, a need existed for a mechanism capable of rotating relatively heavy turrets with guns attached thereto.

U.S. Pat. Nos. 4,686,888 and 4,574,685 disclose turret drive systems for light weight military vehicles. In these systems, a user is located inside the vehicle and controls the turret by a controller which operates two motors, one motor moving the gun vertically and the other motor rotating a platform upon which the gun sits. The system of these patents employs a ring gear which is meshed with a pinion gear at all times so that if the user accidently pushes the wrong button on the controller, the turret will rotate even if the user does not wish it to rotate. Therefore, there is a need for a turret drive mechanism which enables a turret to be locked in a disengaged position in which the turret is prevented from rotating.

Therefore, it has been one objective of the present invention to provide a turret drive assembly which is capable of rotating a relatively heavy turret and gun attached to the turret.

It has been another objective of the present invention to provide a turret drive assembly which is manually driven by an operator located inside the vehicle and which may be locked in a disengaged position.

It has further been an objective of the present invention to provide a turret drive mechanism which has a handle which the operator may use to disengage a drive gear from a ring gear so the turret will not rotate via the mechanism, but the turret may still rotate via the operator's leg power.

SUMMARY OF THE INVENTION

The invention of this application which accomplishes these objectives comprises a turret drive assembly capable of rotating inside a fixed circular ring gear. A turret is fixedly secured to the turret drive assembly. The turret drive assembly comprises a drive mechanism, an aiming wheel, two sprocket wheels, means extending between the first and second sprocket wheels for rotating the sprocket wheels and a drive gear. The drive mechanism comprises a conventional gearing mechanism contained within a housing. An aiming wheel is operatively coupled to the drive mechanism. A first sprocket wheel is similarly coupled to the drive mechanism.

The first sprocket wheel is located generally underneath the drive mechanism and only rotates when the aiming wheel is rotated. The aiming wheel extends radially inwardly from the housing containing the drive mechanism.

An operator is able to stand inside the vehicle and rotate the turret drive assembly by manually rotating the aiming wheel. The turret drive assembly rotates in a circular pattern around a stationary ring gear. As the operator rotates the aiming wheel, he or she must rotate inside the turret so as to follow the circular direction of the aiming wheel.

A rotatable second sprocket wheel is spaced from the first sprocket wheel and a chain, belt or other drive means extends around the exterior of the first and second sprocket wheels and functions to rotate the second sprocket wheel upon the rotation of the first sprocket wheel. The drive means engages teeth surrounding the first and second sprocket wheels. The operator or user rotates the aiming wheel in order to rotate the first sprocket wheel which in turn causes rotation of the second sprocket wheel. The second sprocket wheel is operatively connected to a drive gear via a shaft so that when the second sprocket wheel rotates, the drive gear rotates. Thus, the drive gear is operatively coupled to the second sprocket wheel so that upon rotation of the aiming wheel by the operator, the drive gear rotates. The drive gear is engaged with the ring gear in its normal engaged position so that as the drive gear rotates, the entire turret drive assembly rotates relative to the stationary ring gear.

Above the ring gear a cylindrical turret is affixed to a mounting plate which is part of the housing which encloses the drive mechanism. The mounting plate has a plurality of holes therethrough and forms part of the turret drive assembly. Fasteners extend through the holes in the mounting plate and secure the rotatable turret to the mounting plate and, hence, to the turret drive assembly.

The turret drive assembly of the present invention further comprises means for disengaging the drive gear from the ring gear and locking the drive gear in a disengaged position. The means which accomplishes this is a disengagement assembly. This disengagement assembly comprises an upper and lower pair of linkage members. Each pair of linkage members has an outer linkage member and an inner linkage member. A locking bar is fixedly secured to the outer member of the upper pair of linkage members. Each of the linkage members is secured to a horizontal plate secured to the housing of the drive mechanism described hereinabove. The other ends of the linkage members are secured to bearing members. The pair of upper linkage members are secured to an upper bearing member and the pair of lower linkage members are secured to a lower bearing member. Each of the upper and lower bearing members have a hole centrally located therethrough through which a common shaft passes. Each bearing member comprises a bearing housing and a bearing. The common shaft also passes through centrally located apertures in the second sprocket wheel and the drive gear. Thus, the upper and lower bearing members, the drive gear and the second sprocket wheel are all coaxially aligned on the common shaft and fixed thereto.

A protective plate extends between the inner linkage members of the upper and lower pairs of linkage members and is secured thereto. The protective plate has an aperture therethrough. A handle passes through the aperture in the protective plate and is pivotally secured to a horizontal shaft. The horizontal shaft is supported by two brackets fixed to the protective plate which extend radially outwardly from the protective plate. The handle has a handle extension portion which has a notch therein. The handle extension portion extends radially outwardly from the horizontal shaft.

A spring surrounding the horizontal shaft biases the handle extension portion of the handle upwardly. The notch in the handle extension portion engages the locking bar when the inner and outer linkage members of each pair of linkage members are brought together by the user pulling radially inwardly on the handle. When the notch of the handle extension portion is engaged with the locking bar, the drive gear is locked in a disengaged position in which it is pulled away and held away from the ring gear. When the drive gear is in this disengaged position, the turret drive assembly may not rotate via the gearing even if the user accidently rotates the aiming wheel. However, an operator may still rotate the turret using his or her leg power, as was done prior to applicant's invention.

Thus, the disengagement assembly is capable of disengaging the ring gear and drive gear and locking the drive gear in a disengaged position so that the turret will not rotate via the gearing. If the operator rotates the aiming wheel, the drive gear will rotate but because the drive gear is not engaged with the ring gear, the turret will not rotate. However, an operator may still manually rotate the turret without rotating the aiming wheel. This and other objects and advantages of the present invention will be more readily apparent from the brief and detailed descriptions of the drawings.

DETAILED DESCRIPTION OF DRAWINGS

Figure 1:
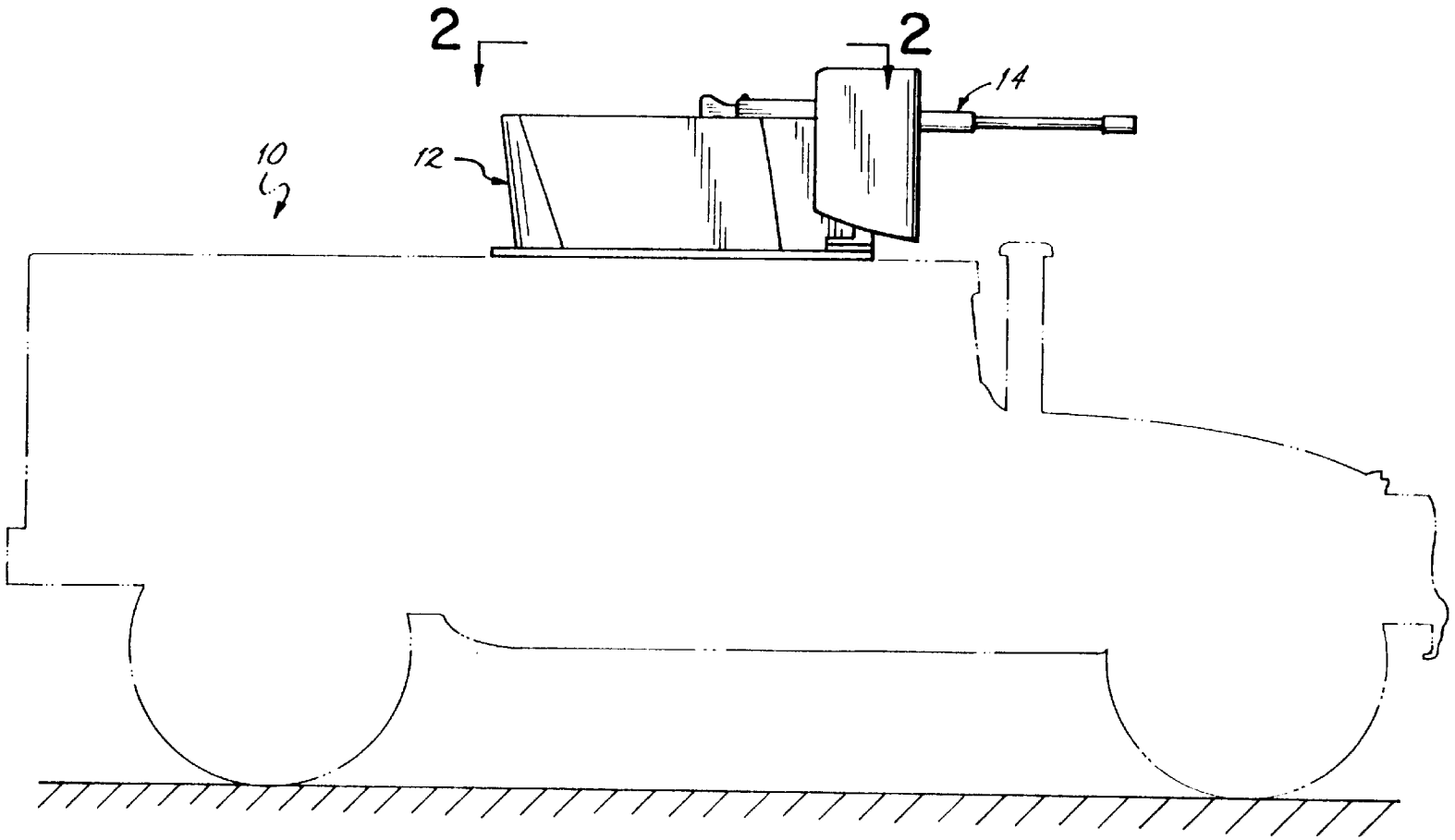
FIG. 1 is a side elevational view of a military vehicle having a turret mounted thereon.
Figure 2:
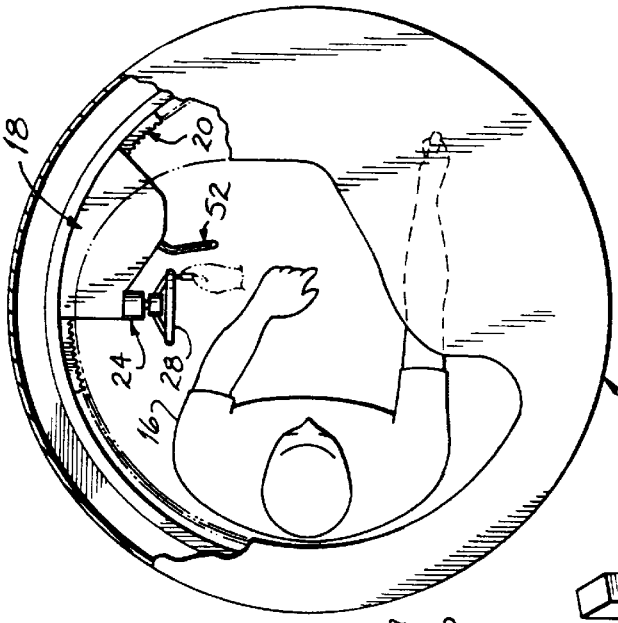
FIG. 2 is a partial top view taken along the lines 2—2 of FIG. 1.

Referring to the drawings and particularly to FIG. 1, there is illustrated a vehicle 10. The vehicle 10 is illustrated as being a HUMVEE vehicle but may be any type of vehicle. Mounted on top of the vehicle 10 is a rotatable turret 12. A gun 14 is mounted to the turret 12 as is conventional in these types of turrets. As seen in FIG. 2, an operator 16 is located inside the vehicle 10 and is able to manually rotate the turret 12 and gun 14 attached thereto by means of a turret drive assembly 18.

Figure 3:
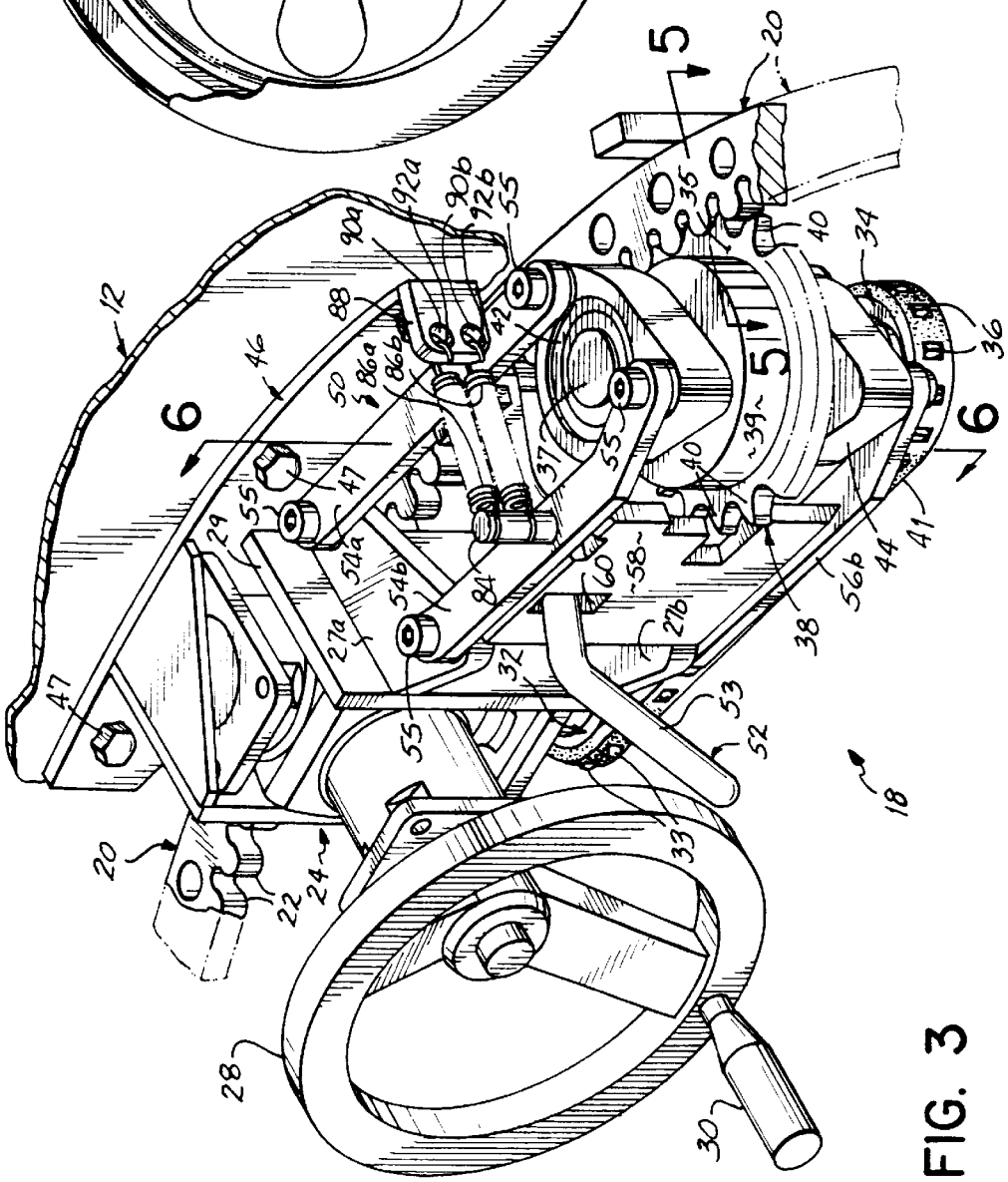
FIG. 3 is a front perspective view of the turret drive assembly of the present invention.

Referring now to FIG. 3, the turret drive assembly 18 is capable of rotating inside a ring gear 20 having teeth 22 which project radially inwardly as is conventional with a ring gear. The ring gear 20 is fixed to the interior of the vehicle and does not rotate relative thereto.

The turret drive assembly 18 comprises a drive mechanism 24 located within a housing 26. The drive mechanism 24 may be a pair of bevel gears or any other type of mechanism which causes rotation of an output shaft from rotation of an input shaft. A pair of parallel horizontal plates 27*a*, 27*b* are secured to vertical plate 29 of housing 26.

An aiming wheel 28 is operatively coupled to the drive mechanism through an input shaft (not shown). A handle 30 extends radially inwardly from the aiming wheel 28 and is grasped by the operator to rotate the aiming wheel 28. A first sprocket wheel 32 is also operatively coupled to the drive mechanism 24 through an output shaft (not shown). The first sprocket wheel 32 has a plurality of exterior teeth 33. Rotation of the aiming wheel 28 causes rotation of the first sprocket wheel 32.

A rotatable second sprocket wheel 34 is spaced from the first sprocket wheel 32. The second sprocket wheel 34 has a plurality of teeth 36 extending radially outwardly and an aperture (not shown) through which a common shaft 37 passes. A chain, belt or other connecting means 41 extends between the first and second sprocket wheels 32, 34 so that upon rotation of the first sprocket wheel 32, the second sprocket wheel 34 will rotate simultaneously. The connecting means or chain 41 engages the teeth 33, 36 of the first and second sprocket wheels 32, 34 respectively. Thus, by rotating the aiming wheel 28, an operator may rotate the second sprocket wheel 34 via the rotation of the first sprocket wheel 32. The second sprocket wheel 34 is located or mounted at the bottom of a vertically oriented common shaft 37.

Mounted on the same shaft 37 above the second sprocket wheel 34 is a drive gear 38 having a plurality of outwardly extending teeth 40. The drive gear 38 has a cylindrical upper portion 39 and a lower portion 35 of which the teeth 40 are a part (see FIG. 3). An upper bearing member 42 is mounted on the shaft 37 above the drive gear 38 and a lower bearing member 44 is also mounted on the shaft 37 between the second sprocket wheel 34 and the drive gear 38 (below the lower portion 35 of the drive gear 38 and above the second sprocket wheel 34). Each bearing member comprises a bearing mounted in a housing. Because the drive gear 38 and the second sprocket wheel 34 are fixedly mounted on the same vertically oriented shaft, rotation of the second sprocket wheel 34 causes rotation of the drive gear 38. Therefore, by turning the aiming wheel 28, the operator may rotate the drive gear 38 via the rotation of the first and second sprocket wheels. The rotation of the drive gear 38 when the drive gear is engaged with the ring gear 20 causes the turret drive assembly as a whole to rotate relative to the ring gear 20.

Figure 4:
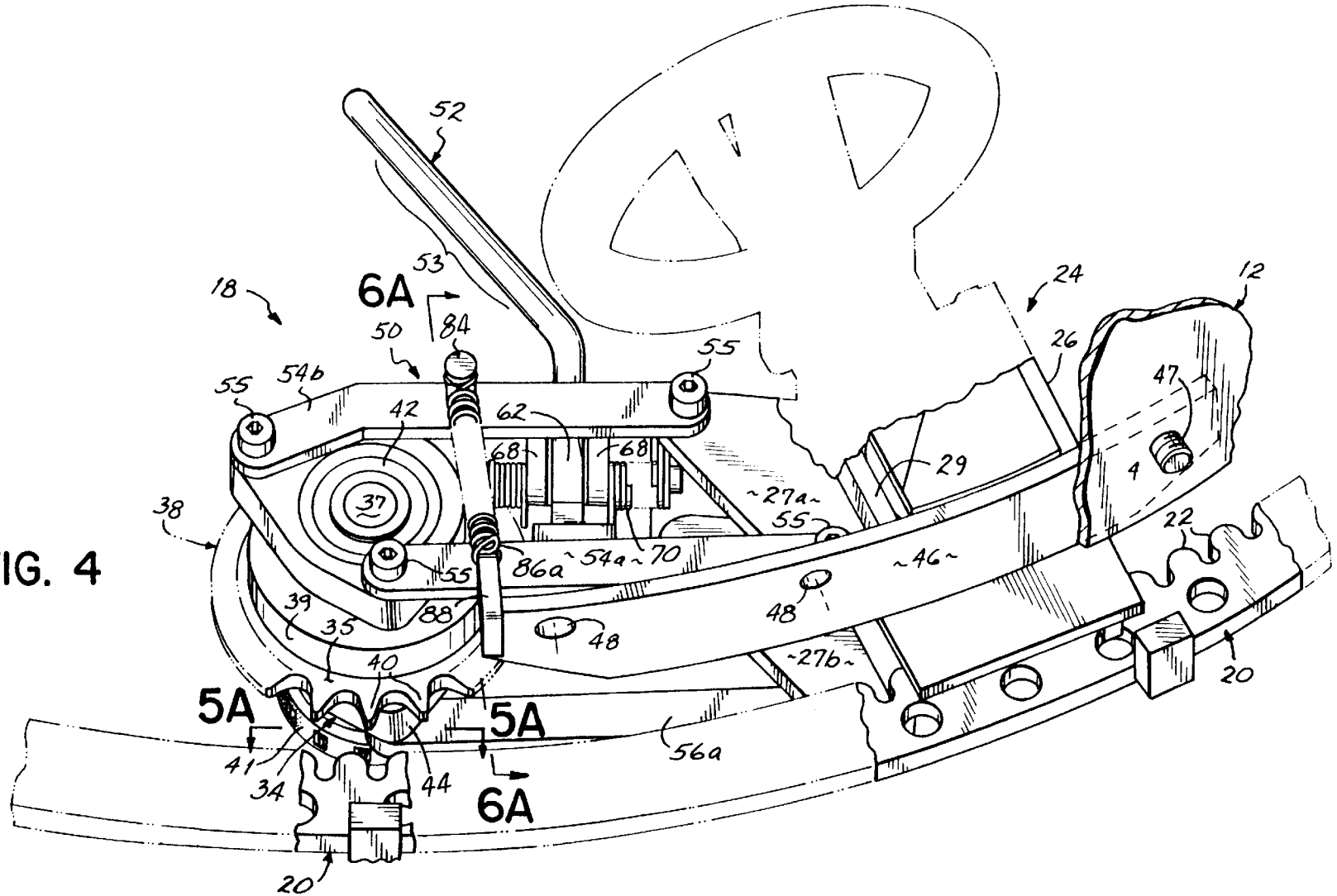
FIG. 4 is a rear perspective view of the turret drive assembly of FIG. 3.

As best illustrated in FIG. 4, a mounting plate 46 having a plurality of apertures 48 is fixedly mounted to the housing 26 of the drive mechanism 24. The mounting plate 46 forms part of the turret drive assembly 18 and rotates with the remainder of the assembly. The turret 12 is mounted to the mounting plate 46. Fasteners 47 pass through the apertures 48 and secure the mounting plate 46 to the turret 12. Thus, by rotating the aiming wheel 28, the operator may rotate the turret drive assembly 18 with the turret 12 attached thereto.

Figure 7:
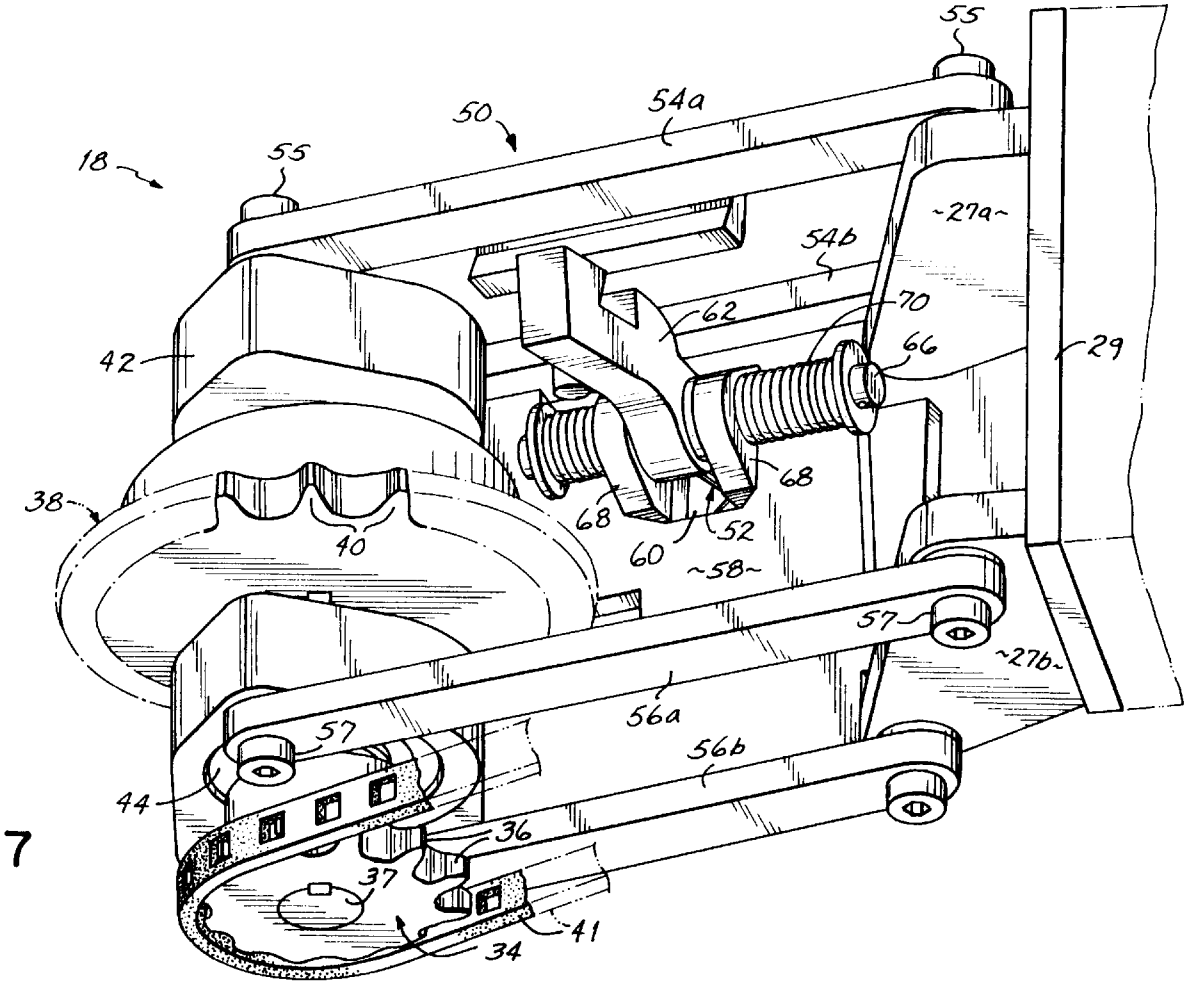
FIG. 7 is a rear perspective view of the disengagement assembly of the present invention.

As best illustrated in FIG. 7, a disengagement mechanism 50 forms a part of the turret drive assembly and is used to disengage the drive gear 38 from the ring gear 20 and hold the drive gear 38 in a disengaged position. While the drive gear 38 is in a disengaged position, rotation of the aiming wheel 28 will not rotate the turret drive assembly 18 and, therefore, will not rotate the turret 12. Thus, if an operator wants to fix the gun 14 in a specific position and not accidently move it, the operator may activate the disengagement assembly via a handle 52 (see FIG. 3) thus causing the drive gear 38 to disengage from the ring gear 20.

The disengagement assembly 50 comprises an upper pair of linkage members 54*a*, 54*b* with outer linkage member 54*a* being located outside of inner linkage member 54*b* (i.e., linkage member 54*a* is farthest away from the operator). Likewise, lower linkage members 56*a*, 56*b* also form part of the disengagement assembly 50 with outer linkage member 56*a* being located outside inner linkage member 56*b*. One end of each linkage member is pivotally secured to one of the horizontal plates 27*a*, 27*b*. The other end of each linkage member is secured to one of the bearing members 42, 44 and, more particularly, to the housing of the bearing member. As best seen in FIG. 7, upper linkage members 54*a*, 54*b* are pivotally secured to horizontal plate 27*a* and bearing member 42 via fasteners 55. Likewise, lower linkage members 56*a*, 56*b* are pivotally secured to horizontal plate 27*b* and bearing member 44 via fasteners 57. As best seen in FIG. 3, a generally vertically oriented protective plate 58 is fixedly secured to the inner linkage members 54*b*, 56*b* and extends between them. The protective plate 58 has a hole 60 therein through which the handle 52 passes.

Figure 6A:
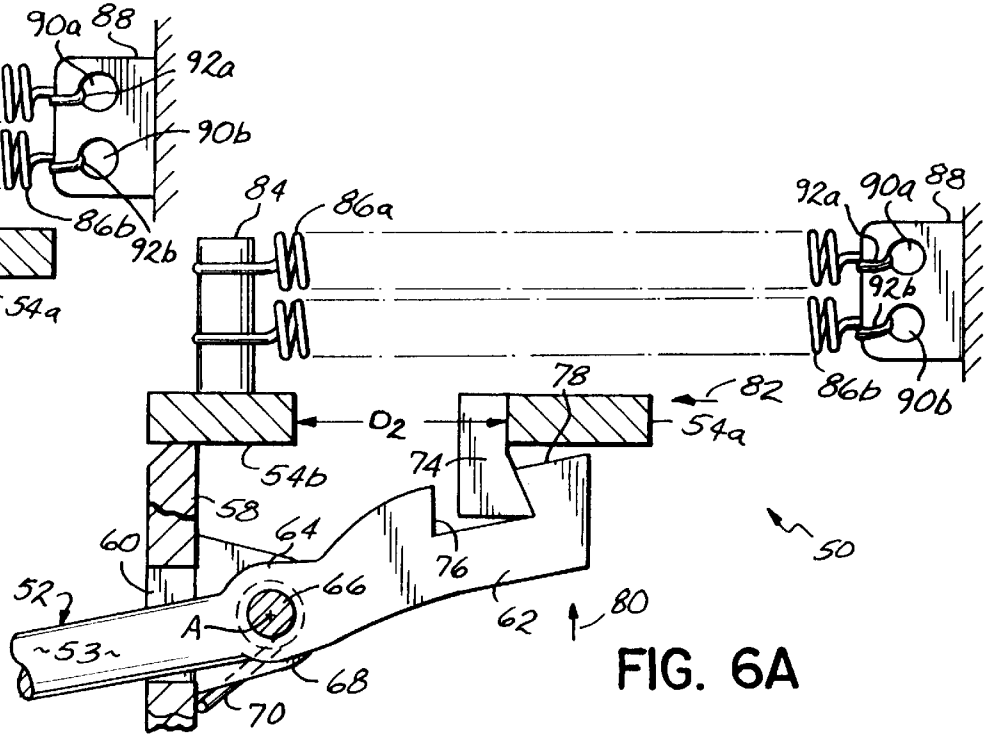
FIG. 6A is a view taken generally along the line 6A—6A of FIG. 4 but illustrating the handle extension portion being engaged with a locking bar in order to disengage the drive gear from the ring gear and hold the drive gear in such a position.
Figure 6:
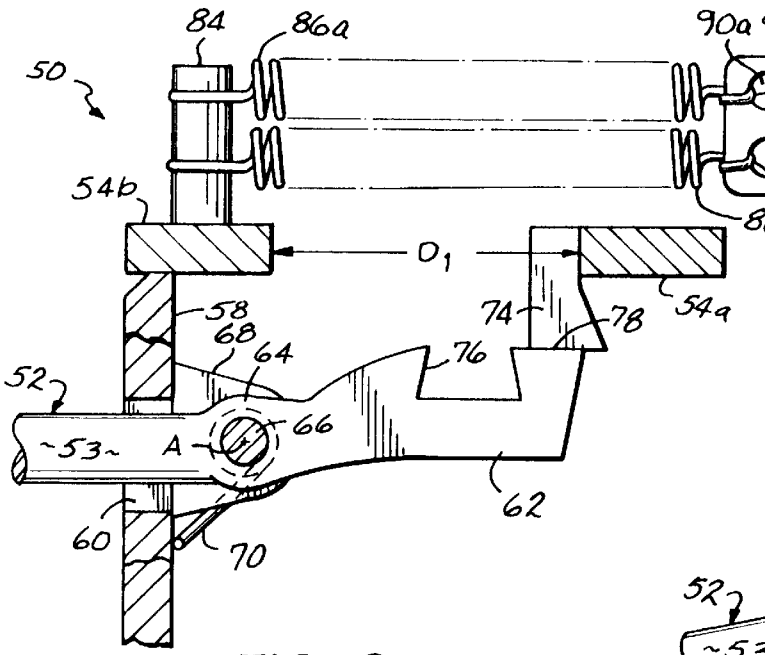
FIG. 6 is a view taken generally along the lines 6—6 of FIG. 3.

Referring now to FIGS. 6 and 6A, handle 52 extends radially inwardly through the hole 60 in the protective plate 58. The handle has an inner portion 53 and an extension portion 62. The handle 52 has a cylinder 64 bored therethrough which receives a generally horizontally oriented shaft 66. The handle 12 is capable of pivoting about a horizontal axis A, defined by the horizontal shaft 66. The shaft 66 is mounted upon two brackets 68 which are fixedly secured to the outer surface of protective plate 58. The inner portion 53 of the handle is located radially inwardly (toward the operator) of horizontal shaft 66 while handle extension portion 62 extends radially outwardly from horizontal shaft 66. As best seen in FIG. 7, spring means 70 surrounds the shaft 66 and biases the handle extension portion 62 of the handle 52 upwardly.

As best illustrated in FIG. 6, a locking bar 74 is fixedly mounted to the outer upper linkage member 54*a*. The handle extension portion 62 of the handle 52 has a notch 76 therein which extends downwardly from the upper surface 78 of the extension portion 62. The notch 76 is sized so as to be capable of receiving the locking bar 74. When the handle extension portion 62 is in the position illustrated in FIG. 6, the ring gear and drive gear are engaged with each other as seen in FIG. 5.

Figure 5A:
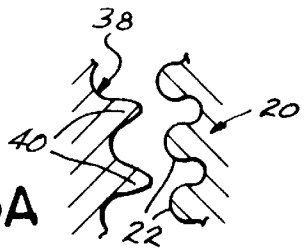
FIG. 5A is a view taken along the line 5A—5A of FIG. 4 but illustrating the drive gear disengaged from the ring gear.
Figure 5:
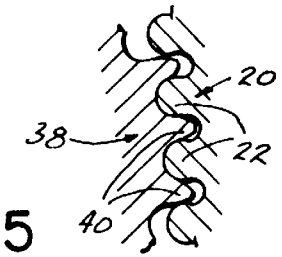
FIG. 5 is a view taken along the line 5—5 of FIG. 3.

As illustrated in FIGS. 5A and 6A, when the operator pulls radially inwardly on the inner portion 53 of handle 52, the protective plate 58 moves towards the operator bringing with it the inner linkage members 54*b*, 56*b*. Due to the orientation of the linkage members and bearing members, the upper linkage members 54*a*, 54*b* come closer together and the lower linkage members 56*a*, 56*b* come closer together as the protective plate 58 approaches the operator. This spacing is best seen in FIGS. 6 and 6A by comparing distances D1 and D2. Simultaneously, the operator pulls downwardly on the inner portion 53 of handle 52 causing the handle extension portion 62 to raise from its position illustrated in FIG. 6 to its position illustrated in FIG. 6A (in the direction of arrow 80) so that the notch 76 engages the locking bar 74. The spring means 70 surrounding horizontal shaft 66 causes the notch and locking bar to stay engaged with one another. This engagement of the locking bar 74 and notch 76 causes the linkage members 54*a*, 54*b* to remain close together after the outer linkage member 54*a* has moved in the direction of arrow 82. This movement of the upper and lower linkage members causes the locking bar 74 to engage the notch 76 in the handle extension portion 62 of the handle 52. When the disengagement assembly is in the position illustrated in FIG. 6A, the drive gear teeth 40 are not engaged with the ring gear teeth 22 (see FIG. 5A). The aiming wheel 28 may be rotated without causing the turret to rotate because the drive gear 38 is not engaged with the ring gear 20. If the aiming wheel 28 is rotated, the drive gear 38 will rotate but the turret will not rotate. Without any engagement of the teeth of the drive gear with the teeth of the ring gear, rotation of the drive gear will not rotate the turret. However, an operator may still manually cause the turret to rotate using his or her leg power as was commonly done prior to this invention.

As best seen in FIG. 3, a post 84 extends upwardly from the inner linkage member 54*b*. A pair of springs 86*a*, 86*b* extend between the post 84 and a mounting extension 88 extending radially inwardly from the mounting plate 46. The mounting extension 88 has two holes 90*a*, 90*b* therein which receive hooks 92*a*, 92*b* of the springs 86*a*, 86*b*. These springs 86*a*, 86*b* cause the inner linkage members 54*b*, 56*b* of the disengagement assembly 50 to be biased radially outwardly.

While we have described one preferred embodiment of the present invention, those skilled in the art will appreciate changes and modifications which may be made to the invention of the present application. Therefore, we do not intend to be limited except by the scope of the following claims.

What is claimed is:

1. A vehicle mounted turret assembly comprising:

a ring gear fixed relative to the vehicle, a drive gear engaged with said ring gear, a rotatable turret operatively connected to said drive gear, and means for rotating said drive gear to rotate said turret, said means comprising a drive mechanism, a wheel operatively connected to said drive mechanism, a first sprocket wheel operatively connected to said drive mechanism, a second sprocket wheel operatively connected to said drive gear, and a chain interconnecting said first and second sprocket wheels, said wheel being operative by a user to rotate said drive gear, and a locking mechanism for locking said drive gear out of engagement with said ring gear.

2. A vehicle mounted turret assembly comprising:

a ring gear fixed relative to the vehicle, a drive gear engaged with said ring gear, a rotatable turret operatively connected to said drive gear, a drive mechanism for rotating said drive gear to rotate said turret, and a locking mechanism for locking said drive gear out of engagement with said ring gear wherein said locking mechanism comprises at least one pair of linkage members operatively associated with said drive gear and a handle having a notch therein engageable with a bar secured to one of said linkage members.

3. In combination, a fixed circular ring gear and a turret drive assembly capable of rotating inside said fixed circular ring gear, said turret drive assembly comprising a drive mechanism, an aiming wheel operatively coupled to said drive mechanism, a rotatable first sprocket wheel operatively coupled to said drive mechanism, a rotatable second sprocket wheel spaced from said first sprocket wheel, means extending between said first and second sprocket wheels for rotating said second sprocket wheel upon rotation of said first sprocket wheel, a drive gear operatively coupled to said second sprocket wheel, said drive gear being engaged with said ring gear whereby rotation of said aiming wheel causes said drive gear to rotate relative to said ring gear causing said turret drive assembly to rotate, and a disengagement mechanism for disengaging said drive gear from said ring gear and holding said drive gear in a disengaged position, said disengagement mechanism comprising at least one pair of linkage members.

4. The turret drive assembly of claim 3 wherein said drive mechanism is contained within a housing.

5. The turret drive assembly of claim 4 further comprising a mounting plate fixed to said housing for mounting a turret.

6. The turret drive assembly of claim 3 further comprising a handle and handle extension portion, said handle extension portion having a notch therein engaged with a locking bar secured to one of said linkage members when said drive gear is disengaged from said ring gear.

7. In combination a fixed circular ring gear having a plurality of inwardly directed teeth and a turret drive assembly capable of rotating inside said fixed circular ring gear, said turret drive assembly comprising a rotatable first sprocket wheel rotated by a drive mechanism, said drive mechanism being contained within a housing, a rotatable second sprocket wheel spaced from said first sprocket wheel, means extending between said first and second sprocket wheels for rotating said second sprocket wheel upon rotation of said first sprocket wheel, a drive gear operatively coupled to said second sprocket wheel, said drive gear having a plurality of teeth engaged with said teeth of said ring gear whereby a user may rotate said turret assembly by rotating a wheel operatively connected to said drive mechanism, and at least one pair of linkage members extending between plates secured to said housing and at least one bearing member operatively coupled to said drive gear, said at least one pair of linkage members functioning to move said drive gear radially inwardly out of engagement with said ring gear.

8. The turret drive assembly of claim 7 further comprising a handle extension for lockingly engaging said at least one pair of linkage members in order to disengage said drive gear from said ring gear.

9. In combination, a turret drive assembly and a fixed circular ring gear having a plurality of inwardly directed teeth, said turret drive assembly being capable of rotating inside said fixed circular ring gear and comprising a drive mechanism contained within a housing, a rotatable first sprocket wheel rotated by said drive mechanism, a rotatable second sprocket wheel spaced from said first sprocket wheel, a member looped around said first and second sprocket wheels causing said second sprocket wheel to rotate when said first sprocket wheel rotates, a drive gear operatively coupled to said second sprocket wheel, said drive gear having a plurality of teeth engaged with said teeth of said ring gear whereby a user may rotate said turret assembly by rotating an aiming wheel operatively connected to said drive mechanism, and a pair of horizontal plates fixedly secured to said housing.

10. The turret drive assembly of claim 9 further comprising a pair of bearing members operatively connected to said drive gear.

11. The turret drive assembly of claim 10 further comprising at least one pair of linkage members, each pair of linkage members extending between one of said bearing members and one of said mounting plates.

12. In combination a fixed circular ring gear having a plurality of inwardly directed teeth and a turret drive assembly capable of rotating inside said fixed circular ring gear, said turret drive assembly comprising:

a drive mechanism contained within a housing, said drive mechanism being operatively coupled to an aiming wheel and to a rotatable first sprocket wheel whereby rotation of said aiming wheel causes said first sprocket wheel to rotate, a rotatable second sprocket wheel spaced from said first sprocket wheel, a member looped around said first and second sprocket wheels causing said second sprocket wheel to rotate when said first sprocket wheel rotates, a drive gear operatively coupled to said second sprocket wheel whereby rotation of said second sprocket wheel causes said drive gear to rotate, said drive gear having a plurality of teeth engaged with said teeth of said ring gear whereby a user may rotate said turret assembly by rotating said aiming wheel, and a disengagement assembly for locking said drive gear in a disengaged position in which said teeth of said drive gear do not engage said teeth of said ring gear.

13. The turret drive assembly of claim 12 wherein said disengagement assembly comprises a pair of horizontal plates secured to said housing, a pair of bearing members operatively coupled to said drive gear and said second sprocket wheel and a pair of linkage members extending between each horizontal plate and each bearing member.

14. The turret drive assembly of claim 13 further comprising a handle and handle extension having a notch therein, said notch being engaged with a locking bar secured to one of said linkage members when said disengagement assembly is in said disengaged position.

15. In combination a fixed circular ring pear having a plurality of inwardly directed teeth and a turret drive assembly capable of rotating inside said fixed circular ring gear, said turret drive assembly comprising:

a drive mechanism, an aiming wheel operatively coupled to said drive mechanism, a rotatable first sprocket wheel operatively coupled to said drive mechanism, a rotatable second sprocket wheel spaced from said first sprocket wheel, means extending between said first and second sprocket wheels for rotating said second sprocket wheel upon rotation of said first sprocket wheel, and a drive gear operatively coupled to said second sprocket wheel, said drive gear being engaged with said ring gear whereby rotation of said aiming wheel causes said drive gear to rotate relative to said ring gear causing said turret drive assembly to rotate, a linkage functioning to pull said drive gear out of engagement with said ring gear and means for holding said drive gear in a disengaged position.

16. The turret drive assembly of claim 15 wherein said means for holding said drive gear in a disengaged position is a handle having a notch engageable with a bar secured to said linkage.

17. In combination, a ring gear fixed to a vehicle and a turret drive assembly comprising:

a drive gear engaged with said ring gear, a rotatable turret operatively connected to said drive gear, and a disengagement mechanism for disengaging said drive gear from said ring gear and holding said drive gear in a disengaged position, said disengagement mechanism comprising at least one pair of linkage members whereby said disengagement mechanism is activated by a handle operatively associated with said at least one pair of linkage members wherein said handle has an inner portion and an extension portion, said extension portion having a notch engageable with a bar secured to said at least one pair of linkage members.

* * * * *

UNITED STATES PATENT AND TRADEMARK OFFICE

CERTIFICATE OF CORRECTION

PATENT NO. : 6,101,917
DATED : August 15, 2000
INVENTOR(S) : Kevin M. Klatte and Dennis J. Malone It is certified that error appears in the above-identified patent and that said Letters Patent is hereby corrected as shown below:

Column 8,
Line 53, "ring pear" to -- ring gear --.

Signed and Sealed this

Eighteenth Day of January, 2005

JON W. DUDAS
*Director of the United States Patent and Trademark Office*